US009938792B2

(12) United States Patent
Pallini et al.

(10) Patent No.: US 9,938,792 B2
(45) Date of Patent: Apr. 10, 2018

(54) REMOTELY OPERATED EXTERNAL TIEBACK CONNECTOR

(71) Applicant: Vetco Gray Inc., Houston, TX (US)

(72) Inventors: Joseph W. Pallini, Houston, TX (US); Rockford D. Lyle, Houston, TX (US); Robert J. Wagner, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 0 days.

(21) Appl. No.: 14/934,898

(22) Filed: Nov. 6, 2015

(65) Prior Publication Data

US 2017/0130546 A1 May 11, 2017

(51) Int. Cl.

| | |
|---|---|
| ***E21B 17/01*** | (2006.01) |
| ***E21B 43/013*** | (2006.01) |
| ***E21B 36/00*** | (2006.01) |
| ***E21B 29/12*** | (2006.01) |
| ***E21B 41/04*** | (2006.01) |
| ***E21B 7/12*** | (2006.01) |
| ***E21B 33/038*** | (2006.01) |
| ***E21B 19/00*** | (2006.01) |
| *E21B 33/06* | (2006.01) |
| *E21B 33/064* | (2006.01) |

(52) U.S. Cl.

CPC ..... *E21B 33/038* (2013.01); *E21B 17/01* (2013.01); *E21B 19/002* (2013.01); *E21B 43/013* (2013.01); *E21B 33/061* (2013.01); *E21B 33/064* (2013.01)

(58) Field of Classification Search

None

See application file for complete search history.

(56) References Cited

U.S. PATENT DOCUMENTS

| | | | |
|---|---|---|---|
| 4,647,254 | A | 3/1987 | Baugh |
| 4,805,657 | A | 2/1989 | Carman |
| 6,293,343 | B1 | 9/2001 | Pallini, Jr. et al. |
| 6,540,024 | B2 | 4/2003 | Pallini |
| 7,537,057 | B2 | 5/2009 | Singeetham |

(Continued)

OTHER PUBLICATIONS

SPE/IADC Drilling Conference 2001, D. Bruce et al, Unplanned Disconnects in Deepwater Drilling: Prevention Measures and Emergency Response.

(Continued)

*Primary Examiner* — Matthew R Buck
*Assistant Examiner* — Douglas S Wood
(74) *Attorney, Agent, or Firm* — Hogan Lovells US LLP

(57) ABSTRACT

An external tieback connector secures to a lower end of a driller riser. The tieback connector has a locking element that engages an external profile on the wellhead housing and an actuating piston within a piston chamber. A hydraulic fluid accumulator is in communication with the piston chamber through a hydraulic circuit having valves. An umbilical extends from a floating platform to the accumulator. Sending a signal through the umbilical opens the valves to supply hydraulic fluid pressure from the accumulator to the piston chamber. An acoustic signal receiver also connects to the hydraulic circuit. An acoustic transducer deployed subsea on a transducer cable will emit an acoustic signal that is received by the receiver. The receiver opens the valves to apply hydraulic fluid pressure to the piston chamber.

18 Claims, 4 Drawing Sheets

(56) References Cited

U.S. PATENT DOCUMENTS

| | | | | |
|---|---|---|---|---|
| 8,181,704 | B2 | 5/2012 | Fenton | |
| 8,297,359 | B2 | 10/2012 | McKay | |
| 8,590,634 | B2 | 11/2013 | Bamford | |
| 8,960,302 | B2 * | 2/2015 | Shilling | E21B 17/015 166/345 |
| 2006/0042791 | A1 | 3/2006 | Hosie et al. | |
| 2011/0127040 | A1 * | 6/2011 | Humphreys | E21B 17/017 166/345 |
| 2012/0000664 | A1 | 1/2012 | Nas | |
| 2012/0085544 | A1 | 4/2012 | Shilling et al. | |

OTHER PUBLICATIONS

Offshore Technology Conference 1979, F.F. Shanks et al, "Experience Drilling in Deepwater High Current Areas".

Subsea Controls and Data Acquisition '98: Cost effective challenges for a geographically expanding industry 1998, D.A. James "Development of Deepwater Workover Control Systems".

A PCT Search Report and Written Opinion issued in connection with corresponding PCT Application No. PCT/US2016/050903 dated Nov. 30, 2016.

* cited by examiner

REMOTELY OPERATED EXTERNAL TIEBACK CONNECTOR

BACKGROUND

1. Field of Invention

The invention relates generally to a subsea wellhead assembly. More specifically, the invention relates to an external tieback connector that may be disconnected from a subsea wellhead housing either with a remote operated vehicle, electrically via an umbilical, or acoustically with am acoustic transducer.

2. Description of Prior Art

One technique for drilling and producing offshore wells involves what is referred to as tieback connections. A floating platform drills and produces the wells. During drilling, the operator will install a subsea wellhead housing at the sea floor at the upper end of the well. An external tieback connector on a lower end of a string of drilling riser locks to an external profile on the wellhead housing. The drilling riser extends from the wellhead housing to a blowout preventer at the upper end of the drilling riser.

After the well has been drilled and the drilling riser removed, the operator installs an internal tieback connector inside the wellhead housing. The internal tieback connecter connects a production riser to the wellhead housing. The production riser extends up to the floating platform. A production tree will be installed on the upper end of the production riser for controlling well field produced from the well.

The conventional method for releasing a drilling riser and external tieback connector from the subsea wellhead housing uses a remote operated vehicle (ROV). The operator deploys the ROV from the floating platform on an ROV umbilical. The ROV engages an ROV interface on the tieback connector, then injects hydraulic fluid under pressure from the ROV into the tieback collector to release the tieback connector locking element from the subsea wellhead housing.

During the drilling process, an emergency may occur in which the operator needs to quickly release the tieback connector and the drilling riser from the subsea wellhead housing. While releasing can be performed with an ROV, it might take two or more hours to deploy an ROV from the floating platform and perform the releasing procedure.

Emergency systems exist for subsea well drilling techniques that do not use an external tieback connector. Rather than connecting a tieback connector to a subsea wellhead housing, a large, complex blowout preventer (BOP) connects to the subsea wellhead assembly. The BOP has rams that may be closed in an emergency. A release mechanism disconnects the drilling riser and upper part of the BOP from the lower part containing the rams. An umbilical extends from the BOP to the drilling platform for performing these emergency steps. The BOP has accumulators with valves that when open deliver hydraulic fluid snider pressure to perform these and other functions. Some subsea BOPs have alternate ways to close rams and release the riser in the event of problems with the umbilical, such as techniques using ROV's and/or acoustic transducers.

SUMMARY OF THE INVENTION

A subsea well apparatus for releasing a drilling riser from a subsea wellhead includes an external tieback connector secured to a lower end of the riser. The tieback connector has a locking element for engaging an external profile on the wellhead housing. The tieback connector has a piston within a piston chamber for actuating the locking element. An umbilical having a communication line extends from a floating platform alongside the riser to the tieback connector. A first releasing means moves the piston and the locking element to a released position in response to a signal from the floating platform over the line of the umbilical.

Also, as an alternative, an acoustic transducer is deployed subsea on a transducer cable from the floating platform. The transducer is configured to emit an acoustic signal into the sea. An acoustic signal receiver mounted to the tieback connector receives the acoustic signal. A second releasing means moves the piston and the locking element to the released position in response to a signal from the floating platform over the transducer cable to the transducer to emit the acoustic signal.

The tieback connector has an ROV (remote operated vehicle) interface. A third releasing means moves the piston and the locking element to the released position in response to engagement by an ROV with the ROV interface.

The first releasing means and the second releasing meats comprise a hydraulic fluid pressure accumulator mounted to the riser adjacent the tieback connector. The accumulator is in fluid communication with the piston chamber.

The first releasing means and the second releasing means also comprise an electro-hydraulic circuit having valves connected to the piston chamber. The accumulator is coupled to the electro-hydraulic circuit.

The first releasing means further comprises an electrical connection between the umbilical and the valves for selectively opening the valves. The second releasing means comprises an electrical connection between the acoustic receiver and the valves for selectively opening the valves.

The umbilical also may include a hydraulic line. The apparatus has means for refilling the accumulator by delivering hydraulic fluid from the surface platform through the hydraulic line. The apparatus may also have means for refilling the accumulator by delivering hydraulic fluid front the ROV through an ROV interface to the accumulator.

BRIEF DESCRIPTION OF DRAWINGS

Some of the features and benefits of the present invention having been stated, others will become apparent as the description proceeds when taken in conjunction with the accompanying drawings, in which.

Figure 1:
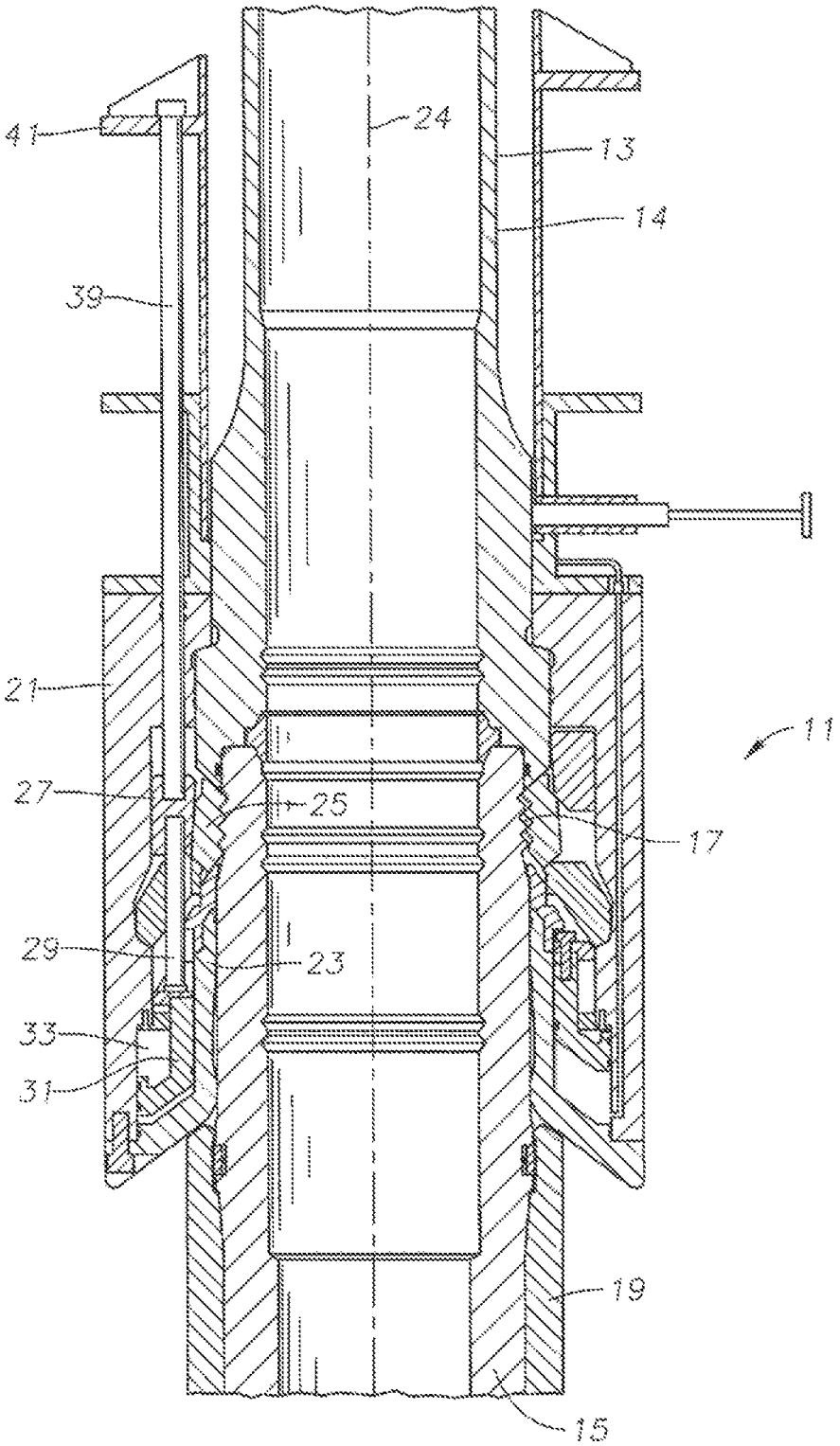
FIG. 1 is a sectional view of a subsea wellhead assembly having an external tieback connector operated in accordance with the present invention.

While the invention will be described in connection with certain embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which certain embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Referring to FIG. 1, an external tieback connector 11 mounts to a lower end of a stress joint 13, which is a lower part of a drilling riser 14. Drilling riser 14 extends up to a floating production platform (not shown). The floating production platform normally has production trees (not shown) at upper ends of production risers for several other wells. The floating production platform may also drill additional wells and employs a drilling riser 14 during drilling. Drilling subsea wells requires a large, complex blowout preventer; in this instance, the blowout preventer (not shown) connects to the upper end of drilling riser 14.

Tieback connector 11 slides over the upper end of a wellhead housing 15 and releasably connects to an external profile 17 on wellhead housing 15. Wellhead housing 15 lands in an outer wellhead 19 and connects to casing (not shown) that will be cemented in the well. After the well has been completed, and after external tieback connector 11 has been removed, an internal tieback connector (not shown) secured to a production riser will he lowered into the bore of wellhead housing 15 and secured. Tieback connector 11 has features to quickly and remotely release itself and drilling riser 14 from wellhead housing 15 in the event of an emergency during drilling operations.

The left side of FIG. 1 shows tieback connector 11 in a locked position and the right side shows tieback connector 11 in a released position. Tieback connector 11 has a cylindrical outer wall 21 and a cylindrical inner wall 23 radially separated from each other by an annular cavity. Outer and inner walls 21, 23 are concentric relative to a longitudinal axis 24 of tieback connector 11. The locking element for tieback connector 11 may comprise a set of dogs 25 circumferentially spaced around inner wall 23. Each dog 25 mounts in a window in inner wall 23 and has a grooved profile on its inner side that engages wellhead housing external profile 17. A cam ring 27 carried in the cavity between outer and inner walls 21, 23 moves axially downward to push dogs 25 radially inward into the engaged position. Upward movement of cam ring 27 allows dogs 25 to move radially outward to a released position.

A plurality of lower rods 29 (only one shown) connect to and extend downward from cam ring 27. A primary piston 31 secures to the lower ends of lower rods 29. Primary piston 31 moves upward and downward in a primary chamber 33 when supplied with hydraulic fluid pressure below and above primary piston 31.

Figure 2:
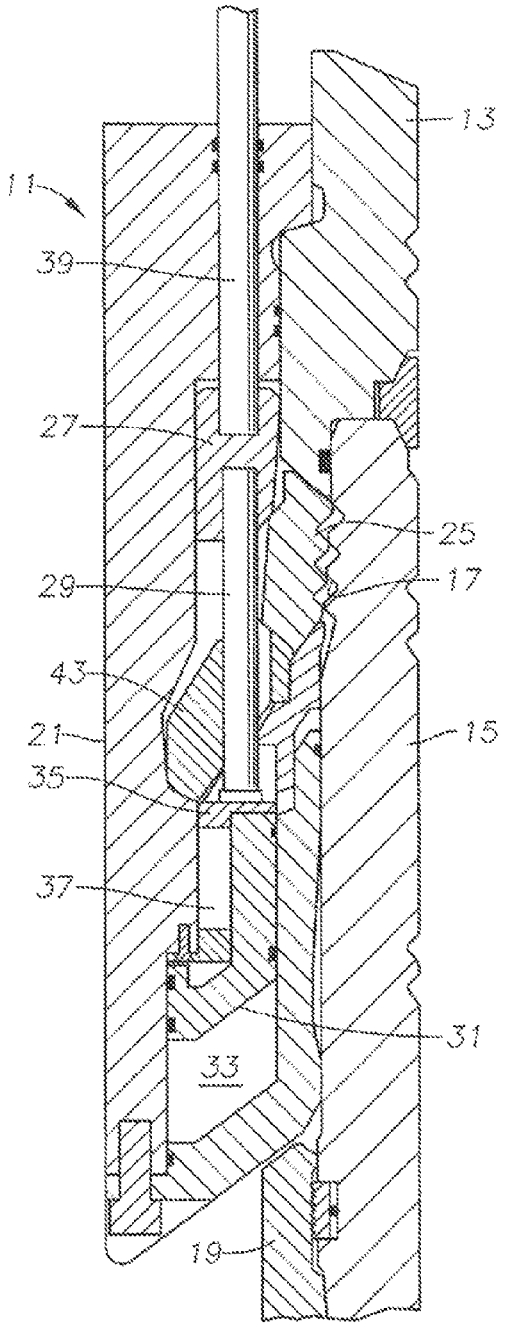
FIG. 2 is an enlarged sectional view of a portion of the external tieback connector of FIG. 1, shown in an unlocked position.
Figure 3:
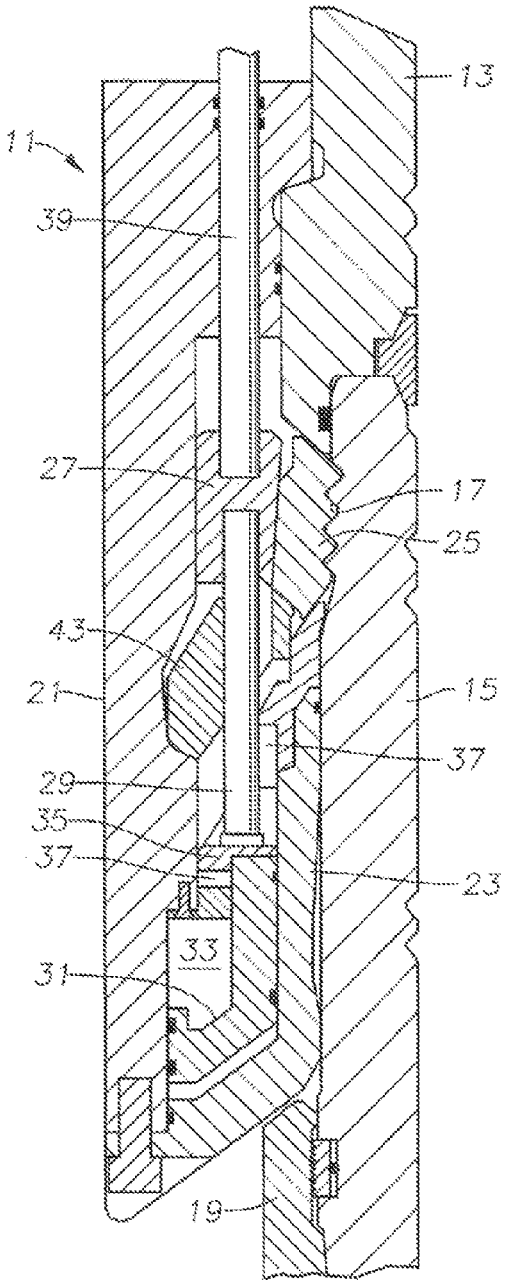
FIG. 3 is an enlarged sectional view of a portion of the external tieback. connector of FIG. 1, shown in a locked position.

Referring to FIGS. 2 and 3, a secondary piston 35 moves in unison with, primary piston 31 and locates in a separate secondary unlock chamber 37 above primary chamber 33. At least part of secondary piston 35 may be integrally formed with primary piston 31, as shown. Hydraulic fluid passages (not shown) within tieback connector 11 extend to primary chamber 33 above and below primary piston 31 to lock and unlock dogs 25. A separate hydraulic fluid passage (not shown) extends to secondary chamber 37 below secondary piston 35 to apply additional force to release dogs 25. Secondary piston 35 serves only to release or assist in releasing dogs 25, not to lock dogs 25.

Figure 4:
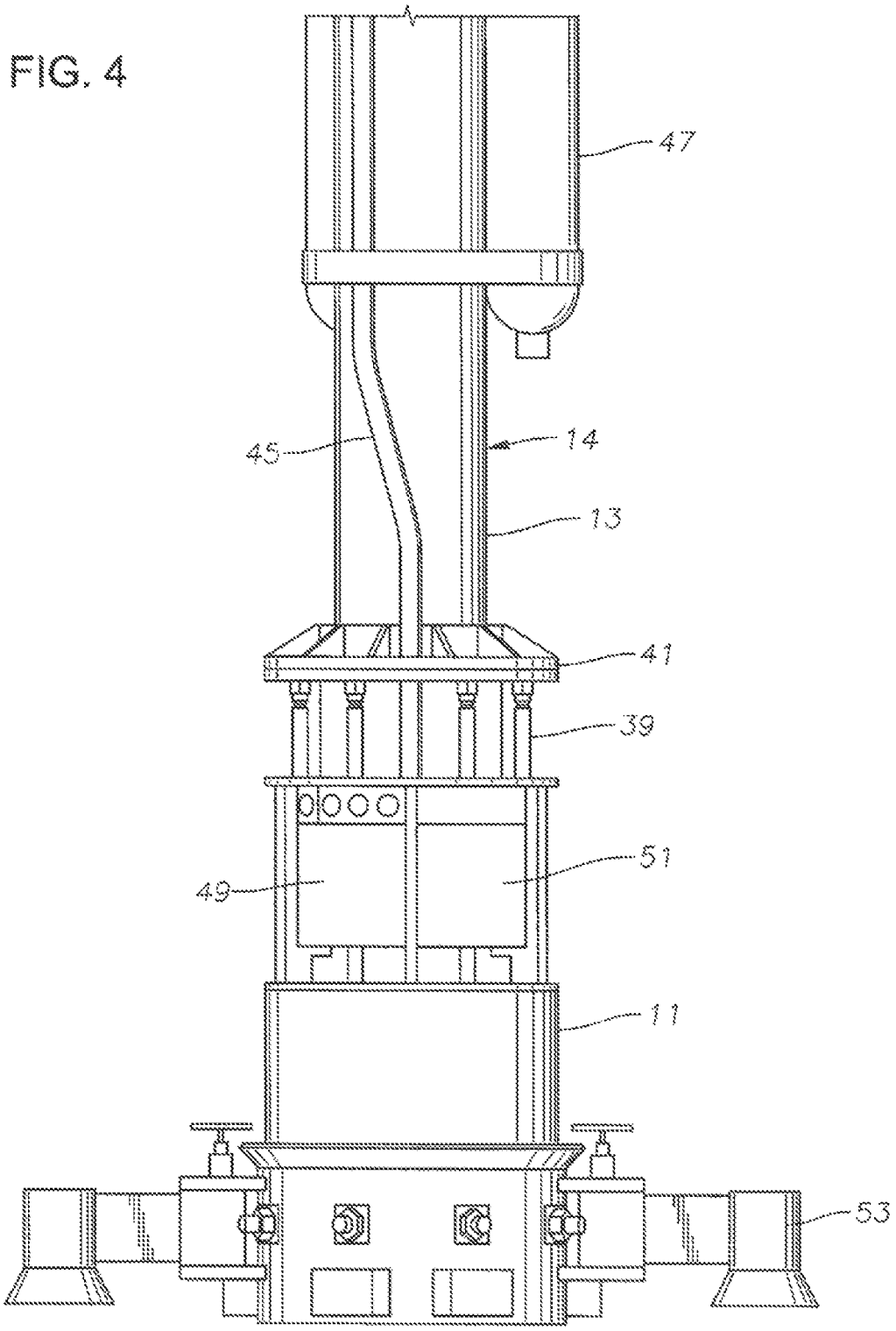
FIG. 4 is a side view of the external tieback connector of FIG. 1.

A plurality of upper rods 39 have lower ends connected to cam ring 27 and extend upward to a yoke 41 that encircles and is axially movable relative to stress joint 13, as shown also in FIG. 4. If primary and secondary pistons 31, 35 are unable to release dogs 25, a hydraulic disconnect tool (not shown) may be placed below yoke 41. The disconnect tool will pry yoke 41 upwards, which pulls cam ring 27 up to release dogs 25.

A load transfer ring 43 locates within the cavity between outer and inner walls 21, 23. Load transfer ring 43 has an upper inner surface that engages lower ends of dogs 25. Load transfer ring 43 has a lower outer surface that engages a shoulder in the interior of outer wall 21. Load transfer ring 43 transfers load between dogs 25 and outer wall 21.

FIG. 2 shows dogs 25 released, and FIG. 3 shows dogs 25 engaged with external profile 17. The released position occurs by supplying hydraulic fluid pressure to primary chamber 33 below primary piston 31. Alternately or in conjunction with hydraulic fluid pressure in primary chamber 33, hydraulic fluid pressure may be supplied to secondary chamber 37 below secondary piston 35 to release or assist in releasing tire connector 11, respectively. The hydraulic fluid pressure moves pistons 31, 35 and cam ring 27 upward.

Referring again to FIG. 4, an umbilical 45 extends from the floating platform down alongside drilling riser 14. Umbilical 45 may be strapped to drilling riser 14 and have a lower end connected to components within internal tieback connector 11. Umbilical 45 optionally has at least one hydraulic line for supplying hydraulic fluid pressure from the floating production platform to tieback connector 11. Umbilical 45 has at least one communication line, which may be electrical, for supplying signals from the floating platform to tieback connector 11.

At least one hydraulic fluid accumulator 47 mounts to stress joint 13 a short distance above tieback connector 11. Two accumulators 47 are shown, and they are cylindrical elongated pressure vessels with axes (not show) roughly parallel with the axis of stress joint 13. Accumulators 47 may be conventional, having a lower hydraulic fluid chamber portion containing hydraulic fluid and an upper portion filled with a compressed gas such as nitrogen. The gas and liquid portions may be separated by a movable barrier.

Tieback connector 11 has an ROV (remote operated vehicle) interface 49 on its exterior for engagement by an ROV (not shown) for locking and unlocking tieback connector 11. Tieback connector 11 may have at least one utility ROV interface 51 on its exterior for engagement by an ROV for re-filling accumulators 47 with hydraulic fluid and optionally recharging with gas. ROV interface 51 could be combined with ROV utility interface 49. The ROV may be a conventional ROV, which is lowered on an ROV umbilical (not shown) for controlling the ROV. ROV interfaces 49, 51 have valve handles that can be engaged and turned by the ROV. Also, ROV interfaces 49, 51 have a hot stab engagement to dispense hydraulic fluid under pressure from the ROV into tieback connector 11. FIG. 4 also shows a conventional guide post guidance unit 53 coupled with tieback connector 11. Guidance unit 53 slides over guide posts (not shown) mounted around wellhead housing 15 (FIG. 1) while tieback connector 11 is being landed.

Figure 5:
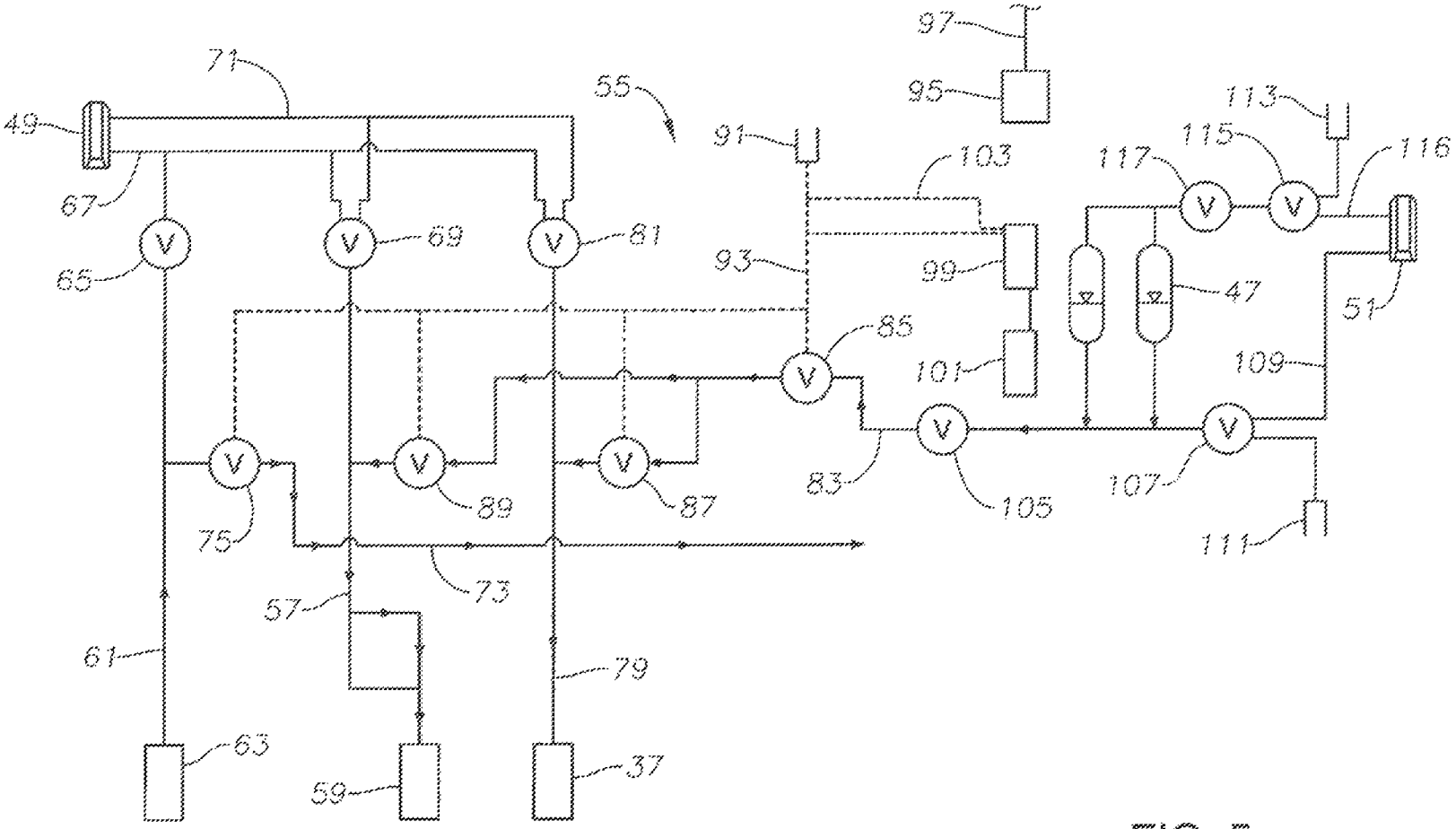
FIG. 5 is an electric and hydraulic schematic of the tieback connector of FIG. 1.

Referring to FIG. 5, tieback connector 11 (FIG. 1) has an electro-hydraulic circuit 55 for moving primary and secondary pistons 31, 35 (FIG. 2). Hydraulic lines or passages are represented by solid lines, and electrical lines by dashed lines. A primary chamber unlock line or passage 57 leads from a primary unlock chamber 59, which is the lower side of primary chamber 33 below primary piston 31 (FIG. 2). A primary chamber lock line 61 leads from a primary lock chamber 63, which is the upper side of primary chamber 33 (FIG. 2) above primary piston 31.

Primary lock line 61 has an ROV valve 65, which may be manually manipulated by an ROV at ROV interface 49. Primary lock line 61 joins an ROV hydraulic fluid inject line 67 leading from ROV interface 49.

Primary chamber unlock line 57 has an ROV valve 69 that also may be controlled by an ROV at ROV interface 49. ROV interface 49 has a hydraulic fluid return line 71 connected to ROV valve 69. ROV valve 69 has one position connecting primary unlock line 57 to ROV inject line 67, another position connecting primary unlock line 57 to ROV return line 71, and a third position that is closed.

A vent line 73 joins primary lock line 61 and vents into the sea. Vent line 73 has a vent valve 75 that is an electrically actuated solenoid type. A branch of vent line 73 leads to primary unlock line 59 and has a solenoid actuated valve 76. Another branch of vent line 73 leads to secondary unlock line 79 and has a solenoid actuated valve 77.

A secondary unlock line or passage 79 connects to secondary unlock chamber 37 (FIG. 2) below secondary piston 35. Secondary unlock line 79 has an ROV actuated valve 81 with one position connecting secondary unlock line 79 to ROV inject line 67, another position connecting secondary unlock line 79 to ROV return line 71, and a third position that is closed.

Accumulators 47 are connected in parallel to an accumulator line or passage 83. A branch of Accumulator line 83 connects to primary unlock line 57 and has an electrically actuated valve 85. A branch of accumulator line 83 joins accumulator line 83 to secondary unlock line 79. An electrically actuated valve 87 is located in the branch of accumulator unlock line 83 leading to secondary unlock line 79. An electrically actuated valve 89 is located in the branch of accumulator unlock line 83 leading to primary unlock line 57.

Electro-hydraulic circuit 55 may also have an accumulator lock line or passage 84 that joins accumulator line 83 and leads to primary chamber lock line 61. One or more solenoid actuated valves 86, 88 are connected in accumulator lock line 84.

Umbilical 45 (FIG. 4) has an unlock communication line or wire 91 extending from the floating platform and connected to an unlock electrical lead 93 of electro-hydraulic circuit 55. Unlock electrical lead 93 connects unlock communication line 91 to the solenoids of valves 75, 85, 87, 89 for providing a signal from the floating platform to open these valves.

Umbilical 45 (FIG. 4) may also have a lock communication line or wire 94 extending from the floating platform and connected to a lock electrical lead 96 of electro-hydraulic circuit 55. Lock electrical lead 96 connects lock communication line 94 to the solenoids of lock line accumulators 86, 88. Lock electrical line 96 also extends to vent solenoid valves 76, 77 for the primary and secondary unlock chambers 59, 37.

An acoustic transducer 95 may be deployed from the floating platform or another vessel in the vicinity with a transducer cable 97. Acoustic transducer 95 emits an acoustic signal into the sea when activated by signals through transducer cable 97. Electro-hydraulic circuit 55 has an acoustic receiver 99. Acoustic transducer 95 will be deployed close enough to tieback connector 11 for acoustic receiver 99 to receive the acoustic signals emitted by acoustic transducer 95. Acoustic receiver 99 has a battery pack and associated circuitry 101 to send an electrical signal over an electrical lead 103 in response to receiving an acoustic signal from acoustic transducer 95. Electrical lead 103 connects to electric lead 93, which in turn is electrically connected to valves 75, 85, 87 and 89.

Tieback connector 11 has features to allow refilling of accumulators 47 If their internal pressures drop below a desired level. A hydraulic fluid refill valve 105 that is normally open connects into accumulator line 83 between accumulators 47 and accumulator valve 85. Another hydraulic fluid refill valve 107 connects to accumulator line 83 between accumulators 47 and an ROV utility line 109 extending from ROV utility interface 51. Umbilical 45 (FIG. 4) has a hydraulic fluid refill line 111 that connects to refill valve 107. Hydraulic recharge valve 107 has one position connecting accumulator line 83 to ROV utility line 109, another position connecting umbilical refill line 111 to accumulator line 83, and a closed position. An open/close valve 108 may be connected into accumulator line 83 between accumulators 47 and refill valve 107.

Hydraulic fluid may be injected into accumulators 47 from umbilical refill line 111 by closing valve 105, opening valve 108, and with valve 107, connecting umbilical refill line 111 with accumulator line 83. Alternately, hydraulic fluid may be injected into accumulators 47 by closing valve 105, opening valve 108, and with valve 107, connecting ROV utility line 109 with accumulator line 83. An ROV connects with ROV utility interface 51 to inject the hydraulic fluid through ROV utility line 109.

Tieback connector 11 may also have a feature to add additional pressurized gas, normally nitrogen, to accumulators 47. Umbilical 45 (FIG. 4) has a gas delivery line 113 that connects to a gas recharge valve 115. Gas recharge valve 115 has one position connecting umbilical gas line 113 to the upper ends of accumulators 47. Gas recharge valve 115 has another position connecting to an optional ROV gas recharge line 116 leading from ROV utility interface 51. Gas recharge valve 115 also has a closed position. A back up open/close valve 117 may be connected between gas recharge valve 115 and accumulators 47.

The gas in accumulators 47 may be recharged from umbilical gas line 113 by opening valve 117 and connecting umbilical gas line 113 to accumulators 47 with gas recharge valve 115. Alternately, an ROV may recharge accumulators 47 by connecting ROV gas recharge line 116 to accumulators 47 with valve 115.

In the connecting operation, tieback connector 11 may be connected to wellhead housing 15 in a conventional manner using an ROV. Referring to FIG. 5, the ROV opens ROV inject valve 65 and places ROV return valves 69, 81 in position for returning displaced fluid from primary unlock chamber 59 and secondary unlock chamber 37 to ROV return line 71. Electrically actuated valves 75, 76, 77, 85, 86, 87, 88 89 remain in their normally closed positions. The ROV injects hydraulic fluid under pressure into primary lock chamber 63, which moves primary piston 31 (FIGS. 2 and 3) down, pushing dogs 25 into the engaged position. During the downward movement of primary piston 31 and secondary piston 33, hydraulic fluid from primary and secondary unlock chambers 59, 37 below pistols 31, 35 returns to the ROV through return line 71.

Umbilical 45 (FIG. 4) may be used to connect tieback connector 11 instead of an ROV. The operator on the floating platform sends a signal through communication line 94 to lock electrical lead 96. Accumulator valve 105 would be preset in a normally open position. The signal opens valves 86, 88 to deliver hydraulic fluid under pressure from accumulator line 83 to primary lock line 63. Lock electrical lead 96 also signals vent valves 76, 77 to vent primary unlock chamber 59 and secondary unlock chamber 37 out vent line 73 while primary piston 31 and secondary piston 35 (FIG. 2) move downward.

An ROV can also be employed in a conventional manner to disconnect tieback connector 11 from wellhead housing 15. The ROV connects primary unlock valve 69 to ROV inject line 67 and optionally connects secondary unlock valve 81 to ROV inject line 67. The ROV injects hydraulic fluid into primary unlock chamber 59 and optionally secondary unlock chamber 37 and vents in a conventional manner. Cam ring 27 moves upward to release dogs 25 (FIG. 2).

However, if an emergency occurs wherein the floating platform needs to quickly release tieback connector 11, considerable time would be required to deploy an ROV subsea and cause it to release tieback connector 11. In that event, the operator may elect to send a signal over umbilical communication line 91. That signal would shift electrically actuated valves 75, 85, 87 and 89 to the open positions. The open valves 85, 87 and 89 direct pressurized hydraulic fluid from accumulators 47 to primary unlock chamber 59 and secondary unlock chamber 37. The open vent valve 75 vents hydraulic fluid on the upper side of primary piston 63 into the sea while primary piston 63 moves upward. Hydraulic fluid will not need to be vented from the upper side of secondary piston 35 in secondary chamber 37 because secondary piston 35 is employed only for unlocking purposes, not locking. Lock line valves 86, 88 and vent line valve 76, 77 remain closed while hydraulic pressure is applied to primary unlock chamber 59 via unlock line 57 and secondary unlock chamber 37 via unlock line 79.

Acoustic transducer 95 may be used in the event umbilical 45 has been damaged such that a communication signal cannot he sent over umbilical communication line 91. The floating platform cause acoustic transducer 95 to emit an acoustic signal. Acoustic receiver 99 receives the signal and sends an electrical signal over electrical leads 103 and 93. Valves 75, 85, 87 and 89 open in response. Hydraulic fluid flows from accumulators 47 to primary and second unlock chambers 59, 37 to release tieback connector 11 from wellhead housing 15 (FIG. 2).

The present invention described herein, therefore, id well adapted to carry out the objects and attain the ends and advantages mentioned, as well as others inherent therein. While certain embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A subsea well apparatus for releasing a drilling riser from a subsea wellhead housing, comprising:

an external tieback connector adapted to be secured to a lower end of the riser, the tieback connector having a locking element for engaging an external profile on the wellhead housing and a seal for pressure containment, the tieback connector having a piston within a piston chamber for releasing the locking element;

an umbilical adapted to extend from a floating platform at an upper end alongside the riser to the tieback connector at a lower end, the umbilical having a communication line;

first releasing means for moving the piston and the locking element to a released position in response to a signal from the floating platform over the communication line of the umbilical;

an acoustic transducer adapted to be deployed subsea on a transducer cable, the transducer configured to emit an acoustic signal;

an acoustic signal receiver mounted to the tieback connector for receiving the acoustic signal; and second releasing means for moving the piston and the locking element to the released position in response to a signal from the floating platform over the transducer cable to the transducer to emit the acoustic signal.

2. The apparatus according to claim 1, further comprising:

an ROV (remote operated vehicle) interface on the tieback connector; and third releasing means for moving the piston and the locking element to the released position in response to engagement by an ROV with the ROV interface.

3. The apparatus according to claim 1, wherein the first releasing means and the second releasing means comprise:

a hydraulic fluid pressure accumulator adapted to be mounted to the riser adjacent the tieback connector, the accumulator being in fluid communication with the piston chamber.

4. The apparatus according to claim 1, wherein the first releasing means and the second releasing means comprise:

an electro-hydraulic circuit having valves connected to the piston chamber; and a hydraulic fluid pressure accumulator adapted to be mounted to the riser adjacent the tieback connector and coupled to the electro-hydraulic circuit.

5. The apparatus according to claim 1, further comprising:

an electro-hydraulic circuit having valves connected to the piston chamber;

a hydraulic fluid pressure accumulator adapted to be mounted to the riser adjacent the tieback connector and coupled to the electro-hydraulic circuit; wherein the first releasing means comprises an electrical connection in the electro-hydraulic circuit between the umbilical and the valves for selectively opening the valves; and the second releasing means comprises an electrical connection in the electro-hydraulic circuit between the receiver and the valves for selectively opening the valves.

6. The apparatus according to claim 5, further comprising:

a hydraulic line in the umbilical; and means for refilling the accumulator by delivering hydraulic fluid from the surface platform through the hydraulic line.

7. The apparatus according to claim 1, further comprising:

an ROV (remote operated vehicle) interface on the tieback connector;

third releasing means for moving the piston and the locking element to the released position in response to engagement by an ROV with the ROV interface;

an electro-hydraulic circuit having valves connected to the piston chamber;

a hydraulic fluid pressure accumulator adapted to be mounted to the riser adjacent the tieback connector and coupled to the electro-hydraulic circuit; wherein the first releasing means comprises an electrical connection in the electro-hydraulic circuit between the umbilical and the valves for selectively opening the valves;

the second releasing means comprises an electrical connection in the electro-hydraulic circuit between the receiver and the valves for selectively opening the valves; and wherein the apparatus further comprises:

means for refilling the accumulator by delivering hydraulic fluid from the ROV through the ROV interface to the accumulator.

8. A subsea well apparatus for releasing a drilling riser from a subsea wellhead housing, comprising:

an external tieback connector adapted to be secured to a lower end of the riser, the tieback connector having a locking element for engaging an external profile on the wellhead housing, a seal for pressure containment, and a piston within a piston chamber for releasing the locking element;

a hydraulic fluid accumulator adapted to be mounted to a portion of the riser adjacent the tieback connector;

a hydraulic circuit having a plurality of solenoid actuated valves connected between the piston chamber and the accumulator;

an umbilical adapted to extend from a floating platform at a first end to the accumulator or the hydraulic circuit at a second end, the umbilical having a communication line;

an acoustic signal receiver mounted to the tieback connector and to the hydraulic circuit;

an acoustic transducer adapted to be deployed subsea on a transducer cable; wherein the tieback connector is releasable from the wellhead housing in response a signal from the floating platform over the communication line of the umbilical to the valves of the hydraulic circuit, which open to deliver hydraulic fluid pressure from the accumulator to the piston chamber to move the piston and the locking element to a released position; and the tieback connector is also releasable from the wellhead housing in response to a signal from the floating platform over the transducer cable to the transducer, which sends an acoustic signal that is received by the receiver, which in response sends a signal to the valves of the hydraulic circuit, which open to deliver hydraulic fluid pressure from the accumulator to the piston chamber to move the piston and the locking element to the released position.

9. The apparatus according to claim 8, further comprising:

an ROV (remote operated vehicle) interface on the tieback connector that is connected to the hydraulic circuit; and wherein engagement by an ROV of the ROV interface delivers hydraulic fluid pressure from the ROV to the piston chamber to move the piston and the locking element to the released position.

10. The apparatus according to claim 8, further comprising:

an ROV (remote operated vehicle) accumulator refill interface on the tieback connector that is connected to the accumulator; and wherein deploying and connecting an ROV to the ROV accumulator refill interface allows hydraulic fluid to be delivered from the ROV to the accumulator.

11. The apparatus according to claim 8, further comprising:

a vent line in the hydraulic circuit extending from the piston chamber on one side of the piston.

12. The apparatus according to claim 8, further comprising:

a hydraulic line in the umbilical, enabling refilling of the accumulator by pumping hydraulic fluid down the hydraulic line in the umbilical.

13. A method of releasing an external tieback connector on a lower end of a drilling riser from a subsea wellhead housing, the tieback connector having a locking element in engagement with an external profile on the wellhead housing, a seal for pressure containment, and a piston within a piston chamber, the method comprising:

(a) mounting a hydraulic fluid accumulator to a portion of the riser adjacent the tieback connector;

(b) connecting an electro-hydraulic circuit having a plurality of solenoid actuated valves between the piston chamber and the accumulator;

(c) extending an umbilical from a floating platform at a first end to the accumulator or the electro-hydraulic circuit at a second end, the umbilical having a communication line;

(d) mounting an acoustic signal receiver to the tieback connector and to the electro-hydraulic circuit;

(e) deploying an acoustic transducer subsea on a transducer cable from the floating platform;

(f) selectively releasing the tieback connector from the wellhead housing by one of the following:

(g) sending a signal from the floating platform over the communication line of the umbilical to the valves of the electro-hydraulic circuit, the valves opening to deliver hydraulic fluid pressure from the accumulator to the piston chamber to move the piston and the locking element to a released position; and (h) causing the acoustic transducer to send an acoustic signal, receiving the acoustic signal with the receiver, and sending a signal from the receiver to the valves of the electro-hydraulic circuit, the valves opening to deliver hydraulic fluid pressure from the accumulator to the piston chamber to move the piston and the locking element to the released position.

14. The method according to claim 13, further comprising:

mounting an ROV (remote operated vehicle) interface on the tieback connector that is connected to the electro-hydraulic circuit; and step (f) is also selectively performed as follows:

deploying an ROV to the ROV interface and delivering hydraulic fluid pressure from the ROV to the piston chamber to move the piston and the locking element to the released position.

15. The method according to claim 14, further comprising:

deploying the ROV to the ROV interface and delivering hydraulic fluid from the ROV to the accumulator to refill the accumulator.

16. The method according to claim 13, wherein:

step (b) also comprises connecting a vent line of the electro-hydraulic circuit to the piston chamber; and steps (g) and (h) also comprise venting hydraulic fluid from the piston chamber on one side of the piston while moving the piston to the released position.

17. The method according to claim 13, wherein:

step (c) further comprises providing the umbilical with a hydraulic line; and the method further comprises:

supplying hydraulic fluid down the hydraulic line of the umbilical to the accumulator to refill the accumulator.

18. The method according to claim 13, wherein:

step (c) further comprises providing the umbilical with a gas conveying line; and the method further comprises:

supplying gas under pressure from the gas conveying line to the accumulator to recharge gas pressure in the accumulator.

* * * * *